US005738252A

United States Patent [19]

Dodd et al.

[11] Patent Number: 5,738,252

[45] Date of Patent: Apr. 14, 1998

[54] UPRIGHT/INVERTED SPRAYER

[75] Inventors: Joseph K. Dodd, Lee's Summit, Mo.; John P. McKernan, Leawood, Kans.

[73] Assignee: Calmar Inc., City of Industry, Calif.

[21] Appl. No.: 848,030

[22] Filed: Apr. 28, 1997

[51] Int. Cl.[6] ..... B67D 5/40

[52] U.S. Cl. ..... 222/376; 222/382

[58] Field of Search ..... 222/376, 383.1, 222/382, 402.19, 321.4

[56] References Cited

U.S. PATENT DOCUMENTS

| | | | |
|---|---|---|---|
| 2,792,974 | 5/1957 | Smith et al. . | |
| 2,793,794 | 5/1957 | Samuel | 222/376 |
| 4,019,661 | 4/1977 | Szabo . | |
| 4,124,149 | 11/1978 | Spitzer et al. | 222/402.19 |
| 5,467,901 | 11/1995 | Foster et al. . | |
| 5,620,113 | 4/1997 | Meshberg | 222/376 |

FOREIGN PATENT DOCUMENTS

| | | |
|---|---|---|
| 208597 | 6/1957 | Australia . |

*Primary Examiner*—Philippe Derakshani

*Attorney, Agent, or Firm*—Watson Cole Stevens Davis, P.L.L.C.

[57] ABSTRACT

A manually actuated liquid pump sprayer is capable of use in both upright and inverted positions without leakage through the vent port by the provision of an auxiliary inlet passage including an inlet port in the path of a slider valve, and a vent port likewise in the path of a slider valve. The vent port is open while the inlet port is closed while the slider valve in the upright attitude of the sprayer, while the converse is effected by the slider valve when operating the sprayer in an inverted position.

9 Claims, 2 Drawing Sheets

UPRIGHT/INVERTED SPRAYER

BACKGROUND OF THE INVENTION

This invention relates generally to a sprayer capable of being operated in both upright and inverted positions allowing liquid to be effectively dispensed without regard to the orientation of the sprayer, while avoiding leakage of product through the container vent when the sprayer is operated in other than the upright position.

Such sprayers of this general class are known, as disclosed in U.S. Pat. No. 5,467,901 in which a ball check valve is movable along a secondary passage communicating with a primary inlet passage to the pump chamber. In downward and inverted positions, the ball valve is seated against a second valve seat at a vent passage so as to open the secondary passage. In the upright position the ball valve is seated against a valve seat at the secondary passage to open the vent passage.

The secondary inlet passage and the opposed ball valve seats are, however, formed integrally with the pump housing thereby requiring special molding of a part or parts of the sprayer assembly which only increases the cost of production and assembly of the sprayer. Besides, often times a ball check valve does not seat quickly enough or tightly enough against its ball seat unless its travel distance to an open position away from its valve seat is limited, or unless the ball check valve is spring biased closed.

Rather than a ball valve, Australian patent 208597 provides a sleeve valve which axially shifts under the force of gravity when the dispenser is inverted to uncover an auxiliary inlet port in the dip tube to facilitate dispensing of liquid stored under pressure.

U.S. Pat. No. 2,792,974 discloses a liquid pump dispenser having a central inlet pipe as well as separate dip tubes for upright and inverted use. The dip tubes are mounted on a sleeve which shifts axially under gravity on a central pipe to uncover alternate inlet ports. In the upright mode, the sleeve seats on a frusto-conical bottom portion of the central pipe.

The known sleeve valves, however, function only to cover and uncover an auxiliary inlet port in upright and inverted attitudes of the dispenser. Thus, for those dispensers having a container vent passage provided to avoid container panelling and hydraulic lock during pumping, the product will leak through the open vent passage during the dispensing operation while the dispenser is in an attitude other than substantially upright.

SUMMARY OF THE INVENTION

It is therefore an object of the present invention to provide a manually actuated liquid pump sprayer capable of being operated in both upright and inverted positions by the provision of a slider valve which in an upright position covers an auxiliary inlet communicating with the primary inlet to the pump chamber, and in an inverted position shifts under gravity to uncover the auxiliary passage. In the upright position the vent passage provided for the sprayer is open but is closed by the shifted valve in the inverted position to thereby avoid leakage of product through the vent path.

The container vent passage, which includes a vent port, lies in the path of the shifting slider valve such that in the inverted position the vent port is thereby covered for sealing the vent path closed against leakage of product from the container.

In one embodiment the vent port is provided in the tube retainer of the pump body, and in another embodiment the vent port is located in a gasket seal provided between the pump body and the container neck.

Other objects, advantages and novel features of the invention will become more apparent from the following detailed description of the invention when taken in conjunction with the accompanying drawings.

DETAILED DESCRIPTION OF THE INVENTION

Figure 1:
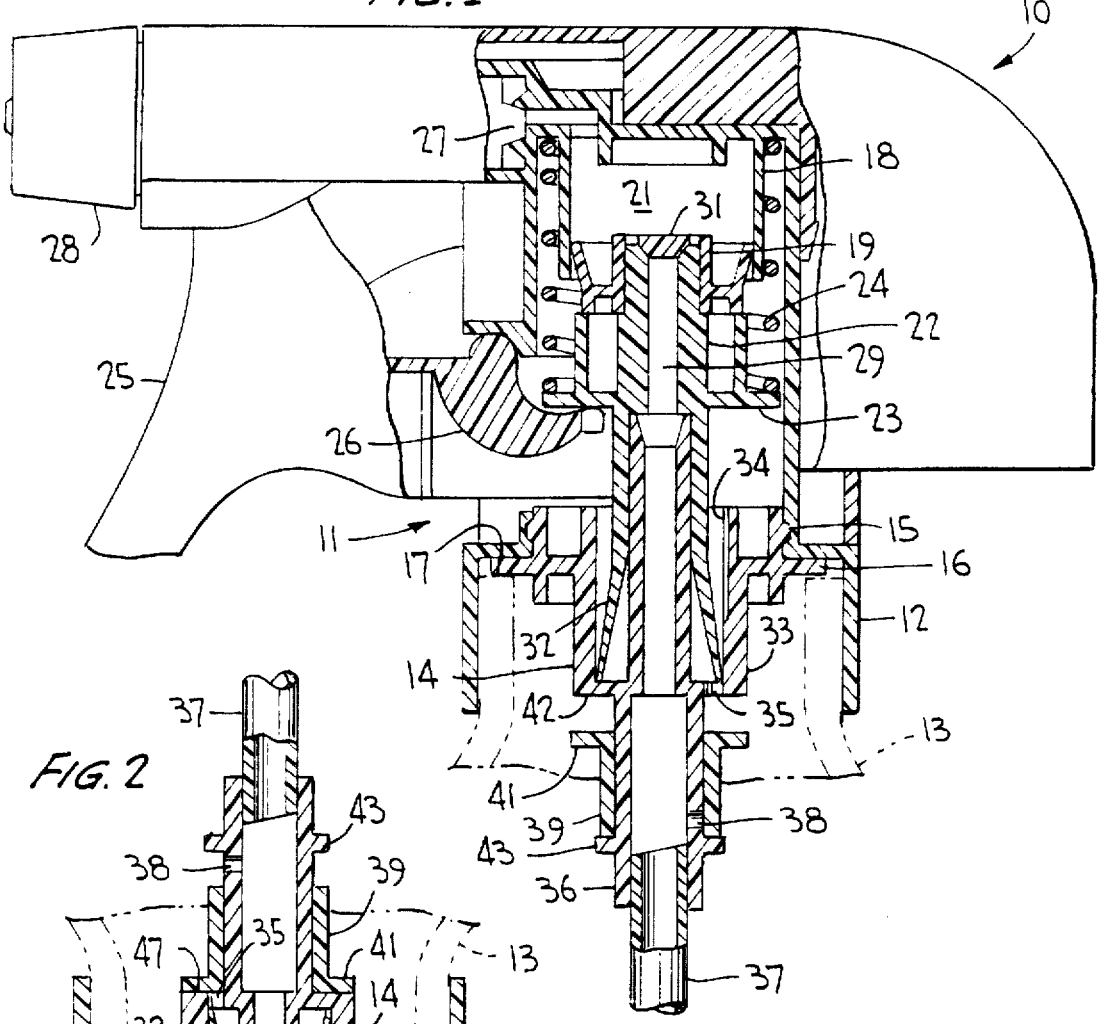
FIG. 1 is a side elevational view, mostly in section, of one embodiment of a trigger sprayer incorporating the invention.

Turning now to the drawings wherein like reference characters refer to like and corresponding parts throughout the several views, one embodiment of the invention is shown in FIG. 1 assembled to a trigger actuated sprayer generally designated 10 having a pump body 11 with a closure 12 for mounting the sprayer to the neck of a container 13 of liquid to be sprayed. A tube retainer 14 is fixed to the pump body as at 15, its flange 16 overlying edge 17 of the container neck. A gasket seal (not shown) may underlie flange 16.

The pump body has a pump cylinder 18 in which a pump piston 19 is reciprocated in sliding sealing engagement to therewith define a variable volume pump chamber 21. The piston may be mounted at the upper end of an elongated stem 22 having a flange 23, a piston return spring 24 extending between this flange 23 and an opposing upper portion of the pump body for resiliently biasing the piston out of its cylinder.

A trigger actuator 25 is pivotally mounted to the pump body in some normal manner, and has a forked arm 26 engaging in the underside of flange 23.

The pump body has a discharge passage 27 extending from the pump chamber through which product is discharged from a discharge orifice (not shown) located in nozzle cap 28. An inlet passage 29 is formed in stem 22 and is valved as at 31 for valving product into the pump chamber during each suction stroke of the dispenser. Valve 31 may be in the form of a spider valve having connected legs formed integrally with the piston, although a flap valve or a ball check valve or the like could otherwise be provided without departing from the invention.

The stem has a depending container vent valve 32 which may be in the form of a downwardly diverging conical lip seal sometimes referred to as a chevron seal in sliding sealing engagement with the wall of a cup member 33 of the tube retainer. Formed on the inner wall of the cup member is one or more longitudinal vent grooves 34, or equivalent longitudinal vent ribs, and the bottom wall of the cup member has one or more vent ports 35 formed therein.

The tube retainer has a retainer sleeve 36 suspending a dip tube 37 which extends into the container and normally curls against a bottom wall of the liquid container, as known in this art. A primary fluid path is established through the dip tube, longitudinally through the tube retainer and along passage 29 into the pump chamber.

In accordance with the present invention, an auxiliary liquid inlet passage is established as by the provision of an inlet port 38 which may be located in sleeve 36 at the upper end of the container interior. A slider valve 39, in the form of a simple sleeve surrounding sleeve 36, and having a transversely extending flange 41 at one end, is capable of sliding between bottom wall 42 of the tube retainer and a stop 43 formed on sleeve 36.

In operation, slider valve 39, in the upright position of the sprayer of FIG. 1, bears against stop 43 and covers secondary inlet port 38 such that, during pumping upon trigger actuation, product is expelled from the pump chamber through the discharge passage. During each pressure stroke vent chevron valve 32 is juxtaposed to vent groove 34 to thereby establish an open vent path from the atmosphere into the interior of the container via vent port 35. Thus, the product expelled from the container during pumping is replaced by air to avoid a sub-atmospheric pressure condition within the container thereby avoiding container panelling and hydraulic lock of the piston. At the end of each suction stroke, vent valve 32 returns essentially to the position shown in FIG. 1 whereupon its reseals with the inner wall of cup member 33 of the tube retainer, to seal the vent passage closed such as during conditions of shipping and storage to avoid leakage of product through the vent.

Figure 2:
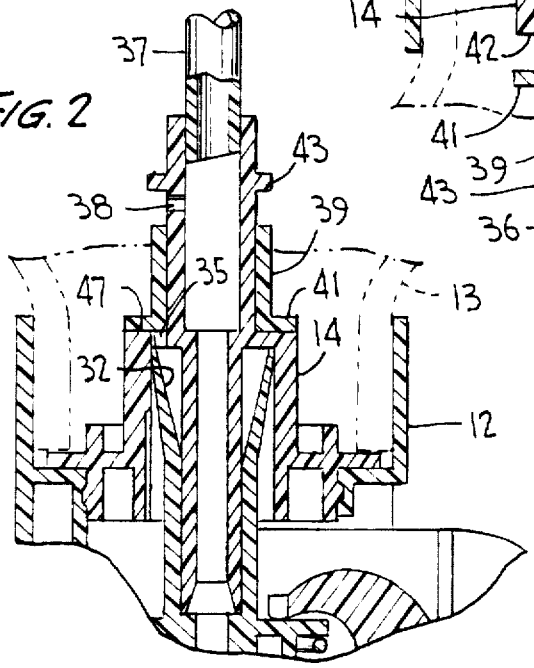
FIG. 2 is a view of part the FIG. 1 trigger sprayer, in vertical section, shown in its inverted position with the slider valve closing the vent port.

In an inverted attitude of the sprayer such as that shown in FIG. 2, valve 39 shifts under gravity into bearing engagement with wall 42 thereby uncovering inlet port 38. Since the inlet port is located in the vicinity of the upper end of the interior of the container, product is drawn into the primary inlet passage through port 38 during each suction stroke of the piston permitting pumping without ingesting air into the pump chamber as would be the case if the free end (not shown) of the dip tube were no longer immersed in the liquid within the container in the FIG. 2 position.

Also, in the FIG. 2 inverted position, vent port 35 is covered by the slider valve to prevent leakage of product through the vent passage during pumping while the trigger is actuated with the sprayer fully or partially inverted.

When the trigger is again uprighted as in FIG. 1, the slider valve simply slides back under the force of gravity into bearing engagement with flange 43 to reclose inlet port 38 and to reopen vent port 35.

Figure 3:
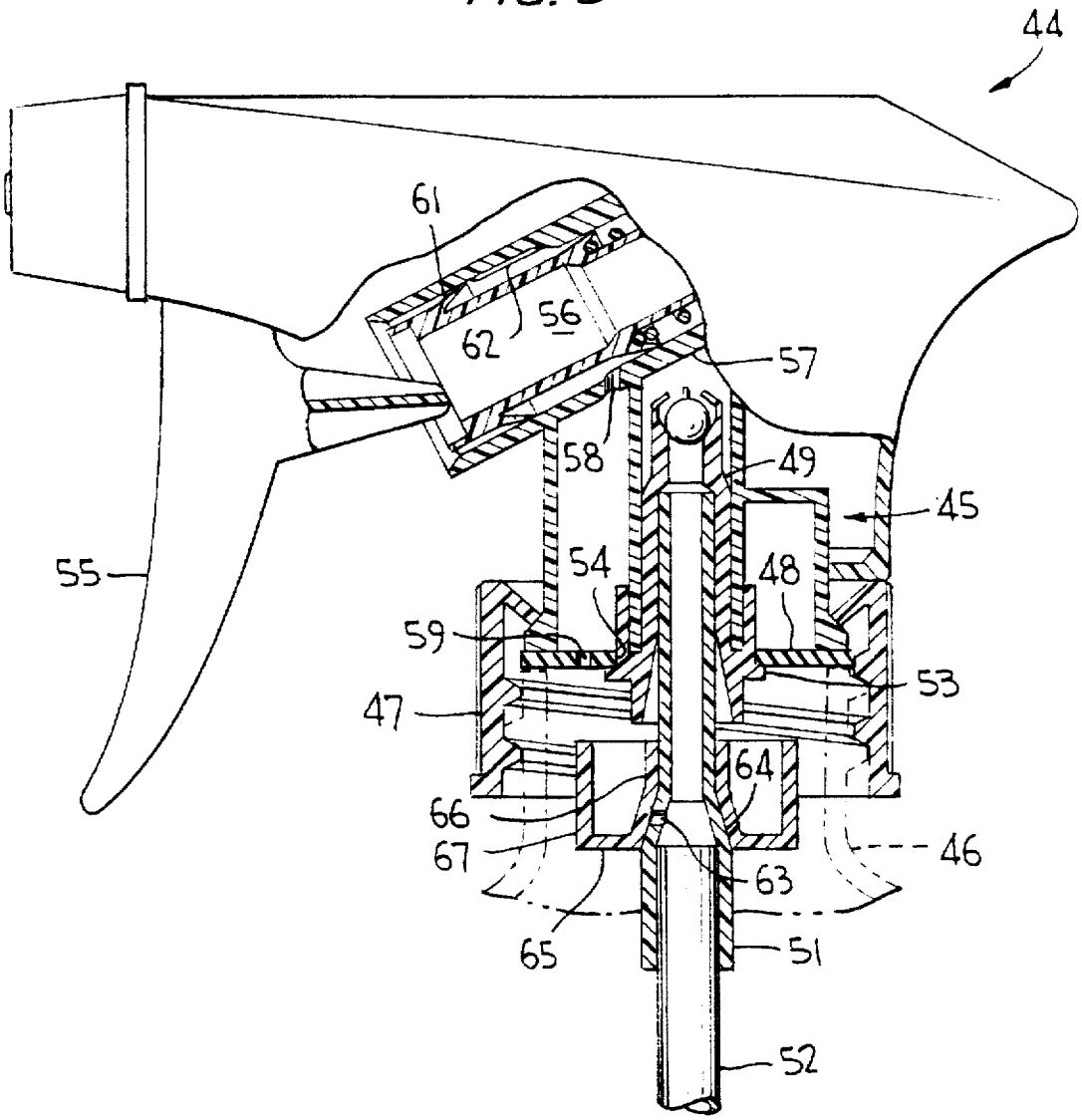
FIG. 3 is a side elevational view, mostly in section, of another embodiment of a trigger sprayer incorporating the invention.

A trigger sprayer generally designated 44 in FIG. 3 incorporates another embodiment of the invention incorporated. The trigger sprayer details are disclosed in U.S. Pat. Nos. 4,747,523 and 5,507,418, commonly owned herewith, the entirety of the disclosures of which being specifically incorporated herein by reference.

Trigger sprayer 44 has a pump body 45 mounted on a container 46 by the provision of a container closure 47, with an intervening gasket seal 48.

A tube retainer 49 is fixed to the pump body, and suspends a tube adaptor 51 which in turns suspends a dip tube 52 extending into the interior of container 46 as in a manner and for the purpose known in this art.

Tube retainer 49 has an external flange 53 which supports the gasket seal at a central opening 54 thereof which, unlike that disclosed in the U.S. Pat. No. 5,507,418, is circular and seals tightly against the surrounding portion of the tube retainer.

A trigger actuator 55 is hingedly mounted to the pump body in some known manner, and functions to reciprocate pump piston 56 within its cylinder bore 57 for the dispensing of liquid from the pump chamber through the discharge passage and out through the discharge orifice located in the nozzle cap. The pump cylinder has a vent port 58 formed in its wall which establishes a vent passage into the interior of the container via another vent port 59 which, according to the invention, is located in the gasket seal. The vent passage is opened to the atmosphere during pumping as a vent seal 61 on the piston is deformed during each pressure stroke as it is juxtaposed to one or more longitudinal vent ribs 62 located on the inner wall of the cylinder bore, as described in more detail in the U.S. Pat. No. 4,747,523.

In accordance with the invention, an auxiliary liquid inlet passage is established by the provision of an inlet port 63 which may be located in tube adaptor 51 at the frusto-conical section 64 thereof and in the vicinity of the upper end of the interior of the container.

Slider valve 65 has an inner sleeve 66 with a frusto-conical section which matches that of section 64, and an outer sleeve 67. The outer sleeve is of a diameter as to be in alignment with vent port 59, and spaced away therefrom as in the open vent condition of FIG. 3.

In operation, slider valve 65 covers inlet port 63 while the sprayer is being operated in its FIG. 3 upright position. Liquid is ejected from the sprayer during each squeeze of the trigger, and is ingested into the pump chamber during each piston suction stroke as liquid flows through the inlet passage established by the dip tube, tube adaptor and tube retainer. And, since the dip tube is stationary, slider valve 65 remains spaced away from vent port 59 such that during each pressure stroke the vent passage is opened to establish venting of the interior of the container from the atmosphere through the open vent passage.

While pumping during an inverted attitude of the trigger sprayer, slider valve shifts under gravity until its outer sleeve 67 bears against the underside of the gasket seal. Since vent port 59 is in alignment with the outer sleeve, the vent passage is thereby closed, and inlet port 63 is correspondingly opened. Thus, during pumping, liquid is ingested into the pump chamber via the auxiliary inlet passage through open inlet port 63 which is located in the vicinity of the upper end of the interior of the container. At the same time any leakage of product through the vent passage is prevented by the outer sleeve of the slider valve which now blocks port 59.

From the foregoing it can be seen that a simple and efficient yet highly effective valve arrangement to facilitate upright and inverted spraying has been devised by the provision of a slider valve which simultaneously closes an auxiliary inlet port and opens a vent port during spraying while the dispenser is upright, and which simultaneously closes the vent port and opens the auxiliary inlet port while spraying in an inverted attitude of the sprayer. The vent and inlet ports are located in the path of the slider valve, and molding modifications of the sprayer are limited and a minimum number of parts are required when carrying out the invention.

Obviously, many other modifications and variations of the present invention are made possible in the light of the above teaching. It is therefore to be understood that within the scope of the appended claims the invention may be practiced otherwise than as specifically described.

What is claimed is:

1. A manually actuated liquid pump sprayer capable of being operated in both an upright position and in an inverted position, comprising a pump body having means for mounting the body to a container of liquid to be dispensed, means in said body defining a pump chamber, said body having means defining a primary liquid inlet passage extending to said chamber and means defining a liquid discharge passage extending from said chamber, the sprayer having a container vent passage including a vent port establishing communication between an interior of the container and the atmosphere during operation of the sprayer in the upright position, an auxiliary liquid inlet passage including an inlet port extending between the interior of the container at an upper end thereof and said primary passage, the improvement wherein a slider valve is mounted on said primary inlet passage means for sliding movement for blocking the inlet port in the upright position and for blocking the vent port in the inverted position.

2. The dispenser according to claim 1, wherein said primary inlet passage means comprises a retainer for suspending a dip tube extending into the container, said ports being disposed in the path of said slider valve which covers and uncovers said ports, respectively, in said positions.

3. The dispenser according to claim 1, wherein said primary inlet passage means comprises a retainer for suspending a dip tube extending into the container, said slider valve comprising a sleeve covering said inlet port in said upright position, and said valve having a flange covering said vent port in said inverted position.

4. The dispenser according to claim 1, wherein said primary inlet passage means comprises a retainer for suspending a dip tube extending into the container, said slider valve comprising an inner sleeve covering said inlet port in said upright position, and said valve having an outer sleeve covering said vent port in said inverted position.

5. The dispenser according to claim 2, wherein said retainer has a stop for positioning said slider valve covering said inlet port.

6. The dispenser according to claim 5, wherein said stop comprises an external flange on said retainer.

7. The dispenser according to claim 5, wherein said retainer has a conical section defining said stop as a conical section of said valve bears against said stop in said upright position.

8. The dispenser according to claim 1, wherein a gasket seal is provided between said pump body and said container, said vent port being located in said gasket seal.

9. The dispenser according to claim 8, wherein said slider valve has a inner sleeve which covers said inlet port in said upright position, said valve having an outer sleeve in alignment with said vent port for covering same in said inverted position.

* * * * *